United States Patent [19]

Hurko

[11] 4,002,883

[45] Jan. 11, 1977

[54] GLASS-CERAMIC PLATE WITH MULTIPLE COIL FILM HEATERS

[75] Inventor: Bohdan Hurko, Louisville, Ky.

[73] Assignee: General Electric Company, Louisville, Ky.

[22] Filed: July 23, 1975

[21] Appl. No.: 598,243

[52] U.S. Cl. ..... 219/543; 219/464; 338/217

[51] Int. Cl.[2] ..... H05B 3/16

[58] Field of Search ..... 219/203, 462, 463, 464, 219/522, 543, 552; 338/217, 308

[56] References Cited

UNITED STATES PATENTS

| | | | |
|---|---|---|---|
| 2,557,983 | 6/1951 | Linder | 219/543 |
| 2,913,565 | 11/1959 | Kantzow | 219/464 |
| 3,067,315 | 12/1962 | Hurko | 219/543 |
| 3,313,920 | 4/1967 | Gauez | 338/317 X |
| 3,612,828 | 10/1971 | Siegler | 219/464 |
| 3,813,520 | 5/1974 | Brouners | 219/543 |
| 3,883,719 | 5/1975 | Hurko | 219/464 |
| 3,953,711 | 4/1976 | Eck et al. | 219/464 |

*Primary Examiner*—Volodymyr Y. Mayewsky
*Attorney, Agent, or Firm*—Richard L. Caslin; Francis H. Boos

[57] ABSTRACT

An electrical heating unit having a flat utensil-supporting plate of glass-ceramic or other electrical non-conductive material. On the underside of this plate are bonded multiple coil electrical resistance film heaters arranged in a generally closed loop. Each coil or loop is of substantially equal length to have about the same watts density and provide a generally uniform temperature distribution over the top surface of the heating unit.

12 Claims, 5 Drawing Figures

GLASS-CERAMIC PLATE WITH MULTIPLE COIL FILM HEATERS

BACKGROUND OF THE INVENTION

1. Field of the Invention

This invention relates to glass-ceramic plate surface heating units and cooktops which are provided with an electrical resistance film or foil bonded to the underside thereof for heating or cooking purposes.

2. Description of the Prior Art

In order to improve the cleanability of cooktops of domestic ranges as well as built-in counter cooktops, the standard porcelain enamel cooktop surface with separate electrical heating elements or gas burners has been replaced in certain models of appliances by high resistivity glass-ceramic plates, which are heated by either electricity or gas. Such plates are of generally milk-white, opaque, glass-ceramic or crystalline glass material sold under such trademarks as "PYROCERAM," "CER-VIT," and "HERCUVIT." This glass-ceramic material has a low thermal expansion coefficient, and it has a smooth top surface of almost ground glass finish or texture that presents a pleasing appearance and is also readily cleanable, and the continuous surface prevents the drainage of spillovers underneath the cooktop.

Most present day glass-ceramic electric surface units and cooktops use open coil radiant heaters that are separated by an air gap from the utensil-supporting glass plates as is disclosed in U.S. Pat. No. 2,913,565. Such open coil heater assemblies are less efficient thermally than standard electric cooktops with metal sheathed electrical resistance heating elements of spiral configuration which directly support the cooking utensil thereon. The glass-ceramic material has a high thermal mass thus a slow response that requires a longer time to heat up and cool down. Moreover, such open coil heaters have a poor thermal coupling between the heating element and the glass-ceramic plate and hence poor thermal efficiency. In order to transfer the heat from the open coil heater to the glass plate, the heater must operate at very high temperatures and this creates high heat losses. This tends to shorten the life of the heater, and contributes to a high heat buildup within the understructure of the surface unit or cooktop. Such open coil heaters are frequently held in place in a layer of cement within a spiral retaining groove formed in the supporting insulating block. This layer of cement encapsulates the lower portion of the open coil heater which reduces the amount of radiant energy emanating from the heating element, and further lowers its efficiency.

A more efficient open coil heating unit is taught in U.S. Pat. No. 3,612,826 which employs a sinusoidal ribbon heater that is held in place by a plurality of widely spaced staples that are fastened to the insulating support block, thus eliminating the layer of cement.

An early patent in the art of glass-ceramic plate surface heating units using film heaters in U.S. Pat. No. 3,067,315 of the present inventor and assignee. These film heaters did not create a generally uniform temperature distribution across the top surface of the plate surface heating unit.

A recently improvement patent in this art is U.S. Pat. No. 3,883,719 of the present inventor and assignee, where the film heater has a spiral pattern with a biased watts density to provide more of an even distribution of temperature across the top surface of the plate.

Another relevant patent in the art of glass-ceramic cooktops with film heaters is U.S. Pat. No. 3,813,520 where the film heater pattern includes a plurality of narrow sinuous film strips which cover a circular area of pie-shaped slices, and each strip is generally equal to each other in width and length to provide the strips with generally equal electrical resistances. If one of these film strips were to fail by being open-circuited, this heating unit would have an irregular heating pattern in the area of the failure because the film strips are bunched into areas of pie-shaped slices.

A principal object of the present invention is to provide a flat plate surface heating unit or cooktop with electrical resistance conductors of metallic film or foil formed in a pattern of a plurality of coils each having about the same watts density to provide a generally uniform temperature distribution over the top surface of the heating unit.

A further object of the present invention is to provide a glass-ceramic plate surface heating unit of the class described where each coil has about the same length and width and hence the same resistance.

A further object of the present invention is to provide a film heater of the class described with multiple loops of generally symmetrical configuration that are connected in a parallel circuit so that if one loop fails the remaining loops will continue to provide satisfactory heat distribution at a lower power output.

A still further object of the present invention is to provide a film heater of the class described by reducing the watts density of the innermost loop and increasing the watts density of the outermost loop so as to obtain a generally uniform temperature distribution over the top surface of the heating unit.

SUMMARY OF THE INVENTION

The present invention, in accordance with one form thereof, relates to a solid plate cooktop or surface heating unit that is provided with a metallic film heater comprising a plurality of conductive strips connected in parallel and arranged in a generally symmetrical looped configuration. Each conductive strip has about the same length and hence the same watts density to provide a generally uniform temperature distribution over the heated surface.

BRIEF DESCRIPTION OF THE DRAWINGS

This invention will be better understood from the following description taken in conjunction with the accompanying drawings and its scope will be pointed out in the appended claims.

FIG. 1 is a top surface temperature profile across the center of the film heater pattern showing the generally uniform temperature distribution over the heating unit.

DESCRIPTION OF THE PREFERRED EMBODIMENTS

Figure 1:
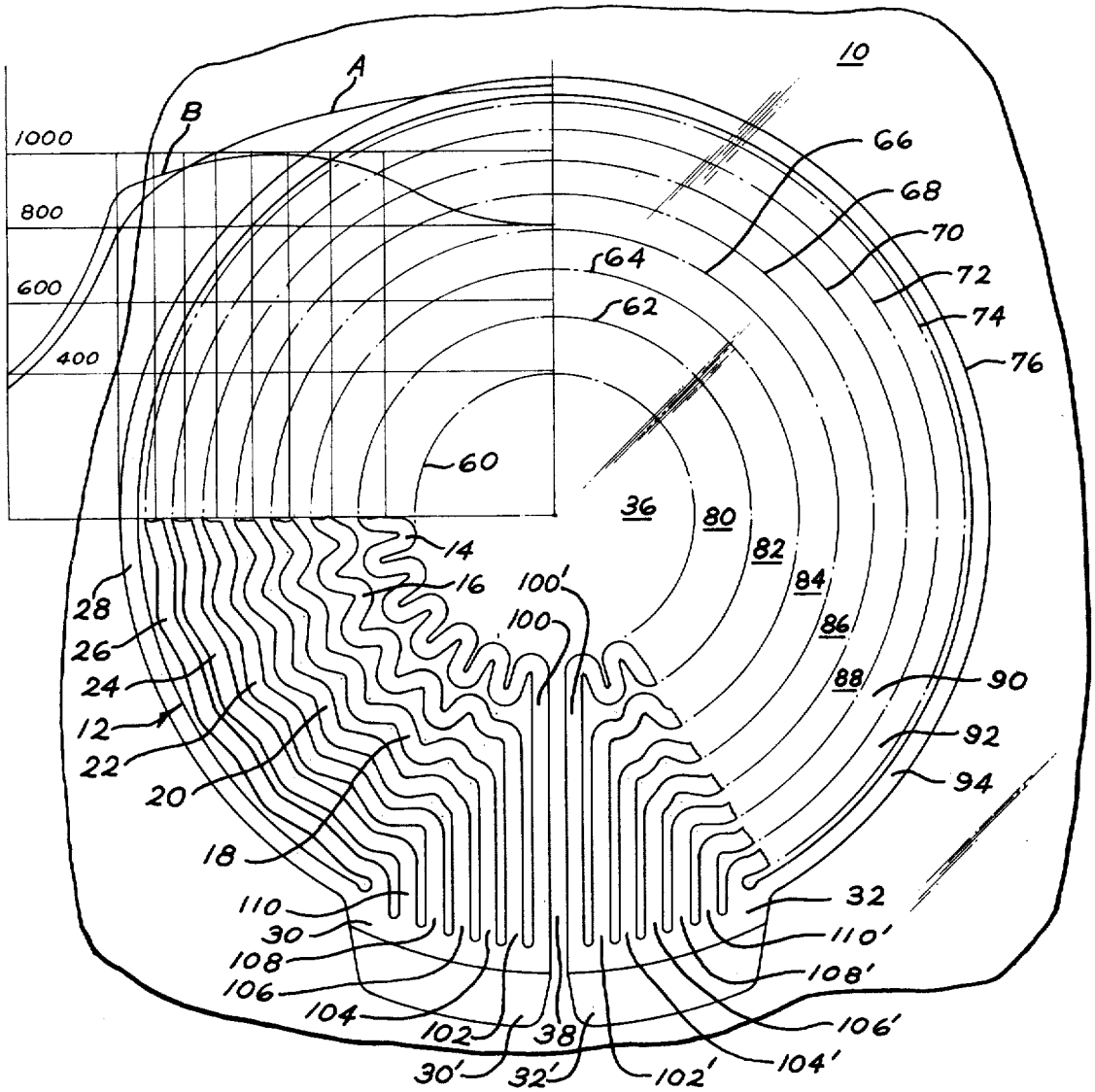
FIG. 1 is a bottom plan view of a solid plate surface heating unit or cooktop showing in detail a preferred embodiment of a film heater pattern of the present invention. Superimposed on this

Turning now to a consideration of the drawings and in particular to FIG. 1, there is shown the undersurface of a plate 10 of a relatively thin, heat resistant, high dielectric glass-ceramic or glassy material having high mechanical strength, low thermal expansion coefficient, good abrasion and thermal shock resistance, and flat and smooth upper and lower surfaces, as is well known in this art. Such plate material is widely known and sold under such trademarks as PYROCERAM, CER-VIT, and HERCUVIT.

Such a glass-ceramic plate 10 could be used as a single surface heating unit or houseware appliance known as a "hotplate" having either a single or a double surface heating means. The glass-ceramic plate 10 could be much larger in area for use with as many as four heated areas and serve as a built-in cooktop mounted flush in a kitchen countertop, or such a cooktop could be included in an electric range and mounted on top of a lower baking and broiling oven (not shown), as is well known in this art.

An electrical resistance heating element 12 of metallic film or foil is bonded to the underside of the plate 10 to have good thermal conductivity therewith. The film 12 may be made of layers of gold and platinum as is taught in my earlier U.S. Pat. No. 3,067,315 entitled, "Multi-Layer Film Heaters In Strip Form."

This method of producing thin films for electrical purposes is by metallo organic deposition (MOD). Metallo organics have been used for decorating glass and ceramic tableware for more than 100 years. Because these materials afford a convenient and economical means for producing excellent films, the technology has been introduced to the electronic industry in recent years. By the MOD technique, films of specular noble metals and their alloys may be deposited by firing in air on substrates by thermal decomposition of metallo organics using conventional coating techniques. One leader in thin film technology using metallo organic deposition is the Engelhard Industries Divison of Engelhard Minerals and Chemical Corporation of East Newark, New Jersey.

The film heater 12 is formed by a series of conductive strips 14–28, which are shown as eight in number by way of an example and are connected in parallel and joined at their ends by a common film strip 30 and 32. Joined to each common film strip 30 and 32 is a common terminal 30′ and 32′ respectively of silver or the like. The film heater 12 is arranged in a generally circular pattern, as is best seen in FIG. 1, with an open control area 36 and a narrow radial separation 38 in the vicinity of the two terminals 30′ and 32′.

As a general rule, thin film heaters fail when the film develops a hot spot, due to some film imperfection or defects in the surface of the substrate such as "seeds" or small open bubbles. Such a hot spot on the film grows progressively hotter which thins out the film until it eventually breaks open. At that instant an electric arc develops to melt the metal and cause it to separate completely.

Figure 2:
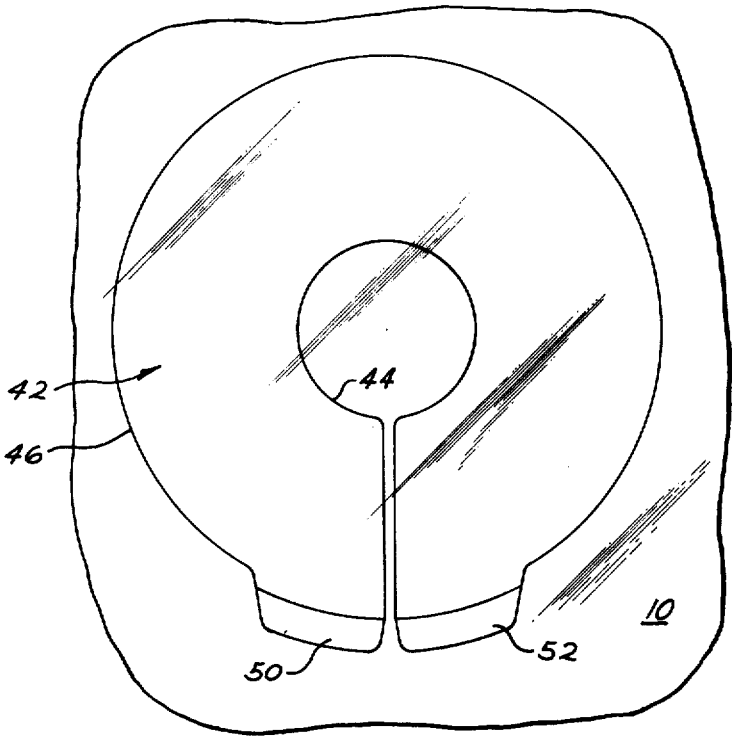
FIG. 2 is a bottom plan view on a reduced scale, similar to that of FIG. 1, showing a single wide band film heater which does not follow the teachings of the present invention and would have an uneven heat distribution.

If the film heater were made as one wide band of film as 42 in FIG. 2, there would be an uneven heat distribution because of a higher current density toward the center of the film heater 42. This higher current density would be caused by the shorter current path for the inner periphery 44 of the film heater 42 as distinguished from the much longer current path for the outer periphery 46 of the film heater 42. Hence, there would be a much higher watts density toward the center of the pattern of the film heater 42 than toward the outer periphery of this film heater 42. This relationship would be just the opposite of good heating unit design for use in cooking, where it is felt the center of the heating unit should include an unheated area and a reduced watts density adjacent that area, and the outer periphery should be biased to a higher watts density to compensate for heat losses in a lateral direction from the outer periphery of the heating unit. The terminals of this film heater 42 are identified as elements 50 and 52.

Figure 3:
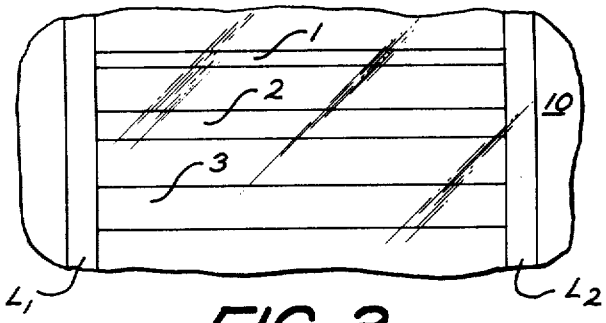
FIG. 3 is a diagrammatic showing of the film heater pattern of the present invention, where there are a plurality of conductive strips connected in parallel between a pair of terminal strips, where each strip has the same length and hence the same watts density. The strips may have the same or different widths but this does not alter the watts density.

In order to reduce the occurrence and seriousness of film heater failures, it is desirable that the film heater be made of a plurality of narrow strips as shown in FIG. 1 as strips or loops 14-28. This film heater configuration 12 of FIG. 1 may be diagrammed as is shown in FIG. 3. The terminals are listed as $L_1$ and $L_2$. There are three film strips shown; namely 1, 2 and 3. The strip resistance in ohms $= R_1 = (1/s_1)\, r$, where $l$ = length, $s$ = width and $r$ = film resistivity in ohms per square. The power in watts $= P_1 =$ $$\frac{E^2}{R_1} = \frac{E^2}{lr/s_1}.$$

The watts density in watts per square inch =

$$W_1 = \frac{P_1}{A_1} = \frac{P_1}{l \times s_1} = \frac{E^2}{lr/s_1 \times ls_1} = \frac{E^2}{l^2 r}.$$

Hence, the watts density is a function of the length of the strip and is not dependent upon the width of the strip. Since the lengths are the same, the watts density is the same for each strip $W_1 = W_2 = W_3 = E^2/l^2r$.

Thus, one modification of the film heater configuration 12 of FIG. 1 has each conductive strip 14–28 as being of the same length, as in FIG. 3, and hence each has the same watts density W, so as to obtain a generally uniform temperature distribution over the top surface of the glass-ceramic plate 10.

Another modification is to have the innermost conductor strip or loop 14 longer in length than the other loops so as to have a lower watts density and hence operate at a lower temperature than the remaining loops so that the center of the heating unit will not operate at a higher temperature than the remainder of the heating unit.

See the temperature profile graph that is superimposed on FIG. 1. The Curve A shows the relatively high temperatures near the center area if there were a uniform watts density across the entire heated area. Curve B shows a preferred generally uniform temperature distribution when the central area is left unheated, and the innermost strip 14 is lengthened to have a reduced watts density.

Another modification is to shorten the length of the outermost strip 28 as compared with the lengths of the remaining strips 14–26. This shortened strip 28 thus would have a higher watts density and hence operate at a higher temperature than the remaining loops to compensate for heat losses in a lateral direction away from the film heater. The Curve B shows the temperature gradient with the outermost strip 28 biased to this higher watts density.

Figure 4:
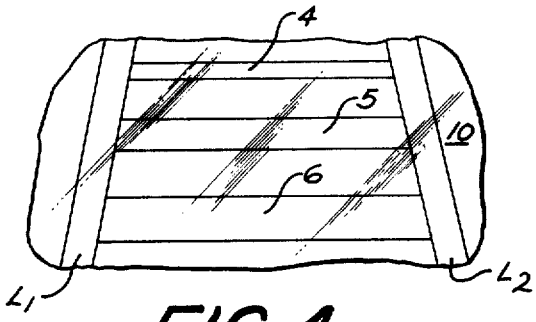
FIG. 4 is another diagrammatic showing of a modification of the film heater pattern of the present invention, where the lengths of the plurality of conductive strips vary from each other, where the innermost strip or loop is the longest and the outermost strip or loop is the shortest, and the lengths of the intermediate strips have a gradual stepped relationship with the adjacent strips or loops.

Another modification is shown in the diagrammatic showing of FIG. 4 where the terminals are again listed as $L_1$ and $L_2$. There are three strips shown; namely 4, 5 and 6. The length of strip 5 is longer than strip 4, and the length of strip 6 is longer than strip 5, $L_6 > L_5 > L_4$. Thus, the watts density for the various strips has the inverse relationship, $W_4 > W_5 > W_6$. Hence, the shorter strip 4 would be an outermost strip, and the longer strip 6 would be toward the center of the film heater pattern, depending upon how many conductive strips would be used.

Figure 5:
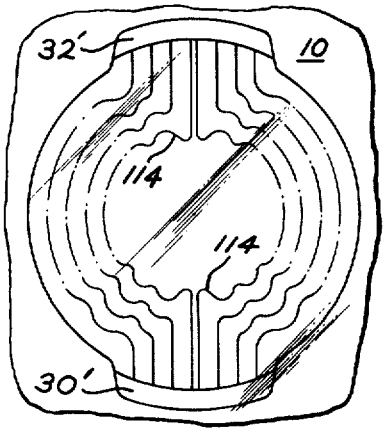
FIG. 5 is a diagrammatic showing of another modification of the film heater pattern of the present invention where the two terminals are arranged on diametrically opposite sides of the heating unit, rather than side by side as in FIG. 1.

Another modification of the present invention is shown in FIG. 5 where the two terminals 30′ and 32′ are rearranged to be on opposite sides of the heating unit from each other. Each conductive strip, such as 114, is of looped configuration and is symmetrical with a corresponding conductive strip, such as 114′. Hence, the conductive strips are arranged in symmetrical pairs. Moreover, the length of each conductive strip is substantially equal and hence of equal watts density in order to obtain a generally uniform temperature distribution over the heating unit. It should be understood that the conductive strips are shown diagrammatically as single lines, but in reality they would each have a finite width similar to the showing in FIG. 1.

Turning back to a consideration of FIG. 1 showing a plurality of narrow strips 14–28, it will be understood that if one of the strips develops a hot spot and fails, the remaining strips will maintain their integrity and continue in operation. Another advantage of such a configuration would be more flexibility in design, particularly when using films with a higher resistance per square, such as MOD (metallo organic deposition) or tin oxide. The MOD gold/platinum films are extremely thin, on the order of 2,000 Angstroms, but in any event less than 0.001 inches, therefore their resistance is high, one ohm per square and higher. If, for instance, a 6 inch diameter, 1,200 watts — 120 volts film heater is made, its coil would have 12 squares (12 ohms). See FIG. 2. The film coil would be 1.23 inch wide and 15 inch long.

The situation would improve if the film heater were operated at 240 watts, because the required resistance would be 48 ohms or 48 squares. However, an 8 inch diameter unit with 2,400 watts and 240 volts would have only 24 squares, and there would again be some design difficulty.

It is advantageous to use thinner film with a higher resistivity than 1 ohm per square because the material cost of the film would drop proportionally.

Turning back to FIG. 1, the film heater 12 consists of eight strips 14–28, each of 96 ohms. For simplicity, each strip is shown of the same width, but the strips could be of different widths, as shown in FIGS. 3 and 4. The heated area of the plate 10 is divided by a series of concentric circles 60–76 into nine equal areas 36 and 80–94. The innermost area 36 is unheated to provide a cooler spot in the center which is important for obtaining a generally uniform temperature distribution as is seen in Curve B in FIG. 1.

If one of the strips 14–28 were to fail, the film heater would operate at 1050 watts. The change in the temperature distribution caused by this failure would not be noticeable to the user because of the symmetrical pattern of the strips.

Each conductive strip 14–26, except the outermost strip 28, is formed in a sine-like curve which is formed in a loop to lie within one of the areas 80–92. The pitch of a sine curve may be defined as the straight line distance or length of a full cycle from one point on the curve to a corresponding point on the next cycle. Notice that the relative pitch of the sine curves 14–26 increases in steps from the innermost strip 14 to the next to the outermost strip 26. The outermost strip 28 is generally circular, hence it has a constant radius and is not formed as a sine curve like the other strips 14–26. It should be understood that the term "sine-like curve" would include many variations such as a square wave without departing from the scope of the present invention.

The terminals 30′ and 32′ are arranged adjacent each other near the periphery of the film heater pattern 12. Hence, to connect the innermost strip 14 to the terminals, the strip 14 has a straight elongated terminal end 100 and 100′ at its ends, which project radially outward and are parallel and closely spaced from each other. The adjacent strip 16 has two similar straight elongated terminal ends 102 and 102′ which are arranged just to the outside of the terminal ends 100 and 100′ respectively. Then the next adjacent strip 18 has similar terminal ends 104 and 104′. Strip 20 has terminal ends 106 and 106′. Strip 22 has terminal ends 108 and 108′. Strip 24 has terminal ends 110 and 110′, and strips 26 and 28 connect directly to the common film strips 30 and 32 which are of enlarged areas to reduce their electrical resistance and hence their operating temperature. This lowered temperature is important in preventing the electromigration between dissimilar noble metals of the film 12 and the silver terminals 30′ and 32′.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. An electrical heating unit comprising a thin plate of high electrical resistivity and high dielectric strength and relatively good thermal conductivity, a plurality of electrical resistance thin film conductors of less than 0.001 inch thickness in physical contact with a surface of said plate, said conductors being of generally symmetrical looped configuration to form a relatively small unheated central area and a relatively large heated area, one terminal end of each loop being joined to a first common terminal strip and the other teminal end of each loop being joined to a second common terminal strip, the length of each conductor being of substantially equal length and of the same resistivity per ohm square and hence of equal watts density in order to obtain a generally uniform temperature distribution over the heating unit.

2. An electrical heating unit as recited in claim 1 wherein at least the innermost conductor loop is longer in length than the other loops so as to have a lower watts density and hence operate at a lower temperature than the remaining loops so that the center of the heating unit will have a lower temperature than the remainder of the heating unit.

3. An electrical heating unit as recited in claim 2 wherein at least the outermost conductor loop is shorter in length than the other loops so as to have a higher watts density and hence operate at a higher temperature than the remaining loops so that the periphery of the heating unit will operate at substantially the same temperature as the remainder of the heating unit.

4. An electrical heating unit as recited in claim 1 wherein a main portion of substantially all of the conductor loops is formed as a sine-like curve, the relative pitch of the sine-like curve increasing from the innermost conductor loop to the outermost conductor loop so that the loops are of substantially equal length.

5. An electrical heating unit as recited in claim 4 wherein the said thin plate is of glassy material, and at least the outermost conductor loop is shorter in length than the other loops so as to have a higher watts density and hence operate at a higher temperature than the remaining loops to compensate for the heat loss radially outwardly through the plate of glassy material in the area surrounding the periphery of the looped conductors.

6. An electrical heating unit as recited in claim 5 wherein at least the innermost conductor loop is longer in length than the other loops so as to have a lower watts density so that the center area of the heating unit will operate at a lower temperature than the remainder of the heating unit.

7. An electrical heating unit as recited in claim 1 wherein the two common terminals strips are arranged closely spaced from each other, at the periphery of the heating unit, the terminal ends of the innermost loop are closely spaced from each other, while the terminal ends of the loop adjacent the innermost loop are closely spaced from the terminal ends of the innermost loop, and the terminal ends of the remaining loops are closely spaced from the terminal ends of the adjacent inner loop.

8. An electrical heating unit as recited in claim 7 wherein the said thin plate of glassy material is a high resistivity glass-ceramic plate, and said electrical resistance conductors are thin films of noble metals and their alloys that are deposited on the glass-ceramic plate by metallo organic deposition at a thickness on the order of 2,000 Angstroms.

9. An electrical heating unit as recited in claim 8 wherein the plurality of film conductor loops are arranged in a generally circular pattern to provide a circular heating unit, and the overall width of each conductor loop pattern is larger at the innermost loop and decreases in steps from the innermost loop to the outermost loop.

10. An electrical heating unit as recited in claim 9 wherein the plurality of film conductors are connected in parallel so that if one conductor loop were to be open-circuited the remaining loops would continue in operation.

11. An electrical heating unit as recited in claim 1 wherein there is a slight difference in the lengths of the conductors, although covering approximately the same area, the innermost conductor having the longest length and the outermost conductor having the shortest length.

12. An electrical heating unit as recited in claim 11 wherein the lengths of the intermediate conductors have a gradual stepped relationship with the adjacent conductors so that the lengths are the longest adjacent the center of the heating unit and are progressively shorter depending upon the spacing away from the center of the heating unit.

* * * * *